US011441830B2

(12) United States Patent
Goldfarbmuren et al.

(10) Patent No.: US 11,441,830 B2
(45) Date of Patent: Sep. 13, 2022

(54) SOLID PRODUCTION SYSTEMS, DEVICES, AND METHODS UTILIZING OLEOPHILIC SURFACES

(71) Applicant: Rebound Technologies, Inc., Commerce City, CO (US)

(72) Inventors: Russell Goldfarbmuren, Denver, CO (US); Luke Erickson, Denver, CO (US); Josh Nelson, West Lafayette, IN (US); Chance Lord, Denver, CO (US)

(73) Assignee: Rebound Technologies, Inc., Commerce City, CO (US)

( * ) Notice: Subject to any disclaimer, the term of this patent is extended or adjusted under 35 U.S.C. 154(b) by 0 days.

(21) Appl. No.: 16/966,542

(22) PCT Filed: Dec. 26, 2019

(86) PCT No.: PCT/US2019/068588
§ 371 (c)(1),
(2) Date: Jul. 31, 2020

(87) PCT Pub. No.: WO2020/139953
PCT Pub. Date: Jul. 2, 2020

(65) Prior Publication Data

US 2021/0310715 A1 Oct. 7, 2021

Related U.S. Application Data

(60) Provisional application No. 62/784,865, filed on Dec. 26, 2018.

(51) Int. Cl.

| | |
|---|---|
| ***F25C 1/12*** | (2006.01) |
| ***F25C 1/04*** | (2018.01) |
| ***F25C 5/187*** | (2018.01) |

(52) U.S. Cl.
CPC ..... *F25C 1/12* (2013.01); *F25C 1/04* (2013.01); *F25C 5/187* (2013.01)

(58) Field of Classification Search
None
See application file for complete search history.

(56) References Cited

U.S. PATENT DOCUMENTS

| | | | |
|---|---|---|---|
| 3,650,121 | A | 3/1972 | Kimpel |
| 3,869,870 | A | 3/1975 | Kuehner |

(Continued)

FOREIGN PATENT DOCUMENTS

| | | | |
|---|---|---|---|
| CN | 1542391 | A | 11/2004 |
| CN | 106796072 | A | 5/2017 |

(Continued)

OTHER PUBLICATIONS

Non-Final Office Action, U.S. Appl. No. 16/750,170, dated Apr. 5, 2021, USPTO.

(Continued)

*Primary Examiner* — Filip Zec
(74) *Attorney, Agent, or Firm* — Wilson Patent Law, LLC

(57) ABSTRACT

Solid production systems, devices, and methods utilizing oleophilic surfaces are provided in accordance with various embodiments. Some embodiments include a water tank used to store fresh water. Some embodiments include an emulsion tank that may include a set of auxiliary components that may be utilized to create and/or to pump an emulsion. This auxiliary equipment may include suction headers, ejectors, pumps, mechanical mixers, and/or hydrodynamic mixers, for example. Some embodiments include a heat exchanger that may produce a cold surface for ice formation. This surface may include an oleophilic surface that may produce an affinity for oils and/or other non-polar materials. Some embodiments include piping that may allow for the connec- (Continued)

tion of the other components such that ice may be formed from a flow of water from the emulsion and the overflow may be returned to the emulsion tank. Ice making methods are also provided.

13 Claims, 8 Drawing Sheets

(56) References Cited

U.S. PATENT DOCUMENTS

| | | | | |
|---|---|---|---|---|
| 3,906,742 | A | 9/1975 | Newton | |
| 4,907,415 | A | 3/1990 | Stewart | |
| 4,953,360 | A * | 9/1990 | Rzechula | E01H 4/023 106/13 |
| 5,218,828 | A | 6/1993 | Hino | |
| 5,858,957 | A | 1/1999 | Donoghue | |
| 6,119,467 | A | 9/2000 | Zusman | |
| 8,012,313 | B2 | 9/2011 | Carson | |
| 8,371,131 | B2 | 2/2013 | Zwieg | |
| 8,449,919 | B2 * | 5/2013 | Shen | A61K 9/5161 424/490 |
| 9,310,140 | B2 | 4/2016 | Muren | |
| 10,544,974 | B2 | 1/2020 | Goldfarbmuren | |
| 11,236,935 | B2 | 2/2022 | Goldfarbmuren | |
| 2004/0167321 | A1 | 8/2004 | Kawagoe | |
| 2005/0191386 | A1 * | 9/2005 | Adams | C12C 5/023 426/72 |
| 2015/0175814 | A1 | 6/2015 | Aizenberg | |
| 2017/0167770 | A1 | 6/2017 | Hemrle | |
| 2019/0101315 | A1 | 4/2019 | Goldfarbmuren | |
| 2020/0263913 | A1 | 8/2020 | Goldfarbmuren | |

FOREIGN PATENT DOCUMENTS

| | | |
|---|---|---|
| EP | 0081913 | 6/1983 |
| FR | 2795810 | 5/2001 |
| JP | S 61-168754 | 7/1986 |
| JP | S64-010076 | 1/1989 |
| JP | H04-313657 | 11/1992 |
| JP | H07-253262 | 10/1995 |
| JP | H10-185379 | 7/1998 |
| JP | H11-281214 | 10/1999 |
| WO | WO87/07250 | 12/1987 |
| WO | WO 2019/046836 | 3/2019 |
| WO | WO 2020/139953 | 7/2020 |

OTHER PUBLICATIONS

Extended European Search Report and Search Opinion, European Appl. No. 18851112.5, dated May 4, 2021, EPO.

Notice of Allowance, U.S. Appl. No. 16/119,661, dated Sep. 4, 2019, USPTO.

International Search Report and Written Opinion, Int'l Appl No. PCT/US2018/049288, dated Dec. 26, 2018, ISA—USPTO.

First Office Action, Chinese Appl. No. 201880056526.8, dated Nov. 24, 2020, CNIPA.

Second Office Action, Chinese Appl. No. 201880056526.8, dated Aug. 11, 2021, CNIPA.

Notification of Reason(s) for Refusal, Japanese Appl. No. 2020-512576, dated Oct. 12, 2021, JPO.

Final Office Action, U.S. Appl. No. 16/750,170, dated Sep. 21, 2021, USPTO.

Notice of Allowance, U.S. Appl. No. 16/750,170, dated Dec. 13, 2021, USPTO.

Notice of Allowance, U.S. Appl. No. 16/750,170, dated Dec. 30, 2021, USPTO.

International Search Report and Written Opinion, Int'l Appl. No. PCT/US19/68588, dated Mar. 25, 2020, USPTO—ISA.

Notification of Reason(s) for Refusal, Japanese Appl. No. 2020-512576, dated Jun. 21, 2022, JPO.

* cited by examiner

SOLID PRODUCTION SYSTEMS, DEVICES, AND METHODS UTILIZING OLEOPHILIC SURFACES

CROSS-REFERENCES TO RELATED APPLICATIONS

This application is a non-provisional patent application claiming priority benefit of U.S. provisional patent application Ser. No. 62/784,865, filed on Dec. 26, 2018 and entitled "SOLID PRODUCTION UTILIZING OLEOPHILIC-COATED SURFACE," the entire disclosure of which is herein incorporated by reference for all purposes.

GOVERNMENT LICENSE RIGHTS

This invention was made with U.S. Government support under Contract 1533939 awarded by the National Science Foundation. The U.S. Government has certain rights in the invention.

BACKGROUND

Different tools and techniques may generally be utilized for solidification and/or solid production, such as ice production, including drop forming, block freezing, flake freezing, and many other techniques.

There may be a need for new tools and techniques to address solidification and/or solid production, such as ice making.

SUMMARY

Solid production systems, devices, and methods utilizing oleophilic surfaces are provided in accordance with various embodiments. Some embodiments utilize self-forming solid-liquid hybrid oleophilic surfaces. Some embodiments include a machine used for the production of ice from water, for example. Some embodiments utilize material combinations and deliberate controlled mixing of those materials to produce ice that can be harvested easily and efficiently. Some embodiments include a water tank used to store fresh water. Some embodiments include an emulsion tank with a set of auxiliary components that may be utilized to create and pump an emulsion. This auxiliary equipment may include precise level suction headers, ejectors, pumps, mechanical mixers, and/or hydrodynamic mixers, for example. Some embodiments include a heat exchanger that may produce a cold surface for ice formation. This surface may include a permanent oleophilic coating that may produce a permanent affinity for oils and/or other non-polar materials. Some embodiments include piping that may allow for the connection of the other components such that ice may be formed from a flow of water and the overflow may be returned to the emulsion tank.

For example, some embodiments include a method of ice making, or solid making more generally. The method may include: delivering an emulsion to an oleophilic surface of a heat exchanger; forming an oil layer on the oleophilic surface of the heat exchanger from oil in the emulsion; growing ice on the oil layer from water in the emulsion; and harvesting the ice. Some embodiments include: curtailing the delivering of the emulsion to the oleophilic surface of the heat exchanger; and/or subcooling the ice on the oil layer after curtailing the delivering of the emulsion to the oleophilic surface of the heat exchanger; this may facilitate the harvesting of the ice.

In some embodiments of the method, delivering the emulsion to the oleophilic surface of the heat exchanger includes flowing the emulsion down the oleophilic surface of the heat exchanger. In some embodiments, harvesting the ice utilizes gravity such that the ice falls away from the oleophilic surface of the heat exchanger.

Some embodiments of the method include pumping the emulsion from an emulsion tank to deliver the emulsion to the oleophilic surface of the heat exchanger. Some embodiments include returning a portion of the emulsion to the emulsion tank after delivering the emulsion to the oleophilic surface of the heat exchanger. Some embodiments include delivering additional water to the emulsion tank.

Some embodiments of the method include forming the emulsion through combining oil and water. In some embodiments, forming the emulsion through combining the oil and the water includes utilizing suction in an emulsion tank to bring the oil and the water together to form the emulsion. In some embodiments, forming the emulsion through combining the oil and the water includes pumping the water to an ejector that forms suction with respect to the oil to bring the oil and the water together to form the emulsion. In some embodiments, forming the emulsion through combining the oil and the water includes utilizing a mechanical mixer to combine the oil and the water.

In some embodiments of the method, the oleophilic surface of the heat exchanger is vertically oriented such that the emulsion flows down the oleophilic surface of the heat exchanger. In some embodiments, the oleophilic surface of the heat exchanger includes at least Polytetrafluoroethylene (PTFE), Fluorinated Ethylene Propylene (FEP), Polyethylene, Nylon, Acetal, Polyvinylidene Fluoride (PVDF), Silicone, or an oleophilic plastic. In some embodiments, the oil includes at least a hydrocarbon oil, a fluorocarbon oil, and a silicone oil.

Some embodiments include an ice making system, or more generally, a solid making system. The system may include an emulsion tank and a heat exchanger that includes an oleophilic surface configured such that an emulsion from the emulsion tank flows down the oleophilic surface to form an oil layer on the oleophilic surface and to form ice on the oil layer.

Some embodiments of the system include a pump that delivers the emulsion from the emulsion tank to the oleophilic surface of the heat exchanger. Some embodiments include a water tank coupled with the emulsion tank to provide water to the emulsion tank. Some embodiments include a suction port positioned with respect to the emulsion tank and the pump to remove water and oil from the emulsion tank to form the emulsion delivered to the oleophilic surface of the heat exchanger. Some embodiments include an ejector positioned with respect to the emulsion tank and the pump to mix water and oil from the emulsion tank to form the emulsion delivered to the oleophilic surface of the heat exchanger. Some embodiments include a mixer positioned with respect to the emulsion tank and the pump to mix water and oil from the emulsion tank to form the emulsion delivered to the oleophilic surface of the heat exchanger.

Some embodiments of the system include the emulsion. In some embodiments, the emulsion includes water and oil. In some embodiments, the oleophilic surface of the heat exchanger is vertically oriented such that the emulsion flows down the oleophilic surface of the heat exchanger. In some embodiments, the oleophilic surface of the heat exchanger includes at least PTFE, FEP, Polyethylene, Nylon, Acetal, PVDF, Silicone, or an oleophilic plastic. In some embodiments, the oil includes at least a hydrocarbon oil, a fluorocarbon oil, and a silicone oil.

Some embodiments include methods, systems, and/or devices as described in the specification and/or shown in the figures.

The foregoing has outlined rather broadly the features and technical advantages of embodiments according to the disclosure in order that the detailed description that follows may be better understood. Additional features and advantages will be described hereinafter. The conception and specific embodiments disclosed may be readily utilized as a basis for modifying or designing other structures for carrying out the same purposes of the present disclosure. Such equivalent constructions do not depart from the spirit and scope of the appended claims. Features which are believed to be characteristic of the concepts disclosed herein, both as to their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of different embodiments may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Figure 1A:
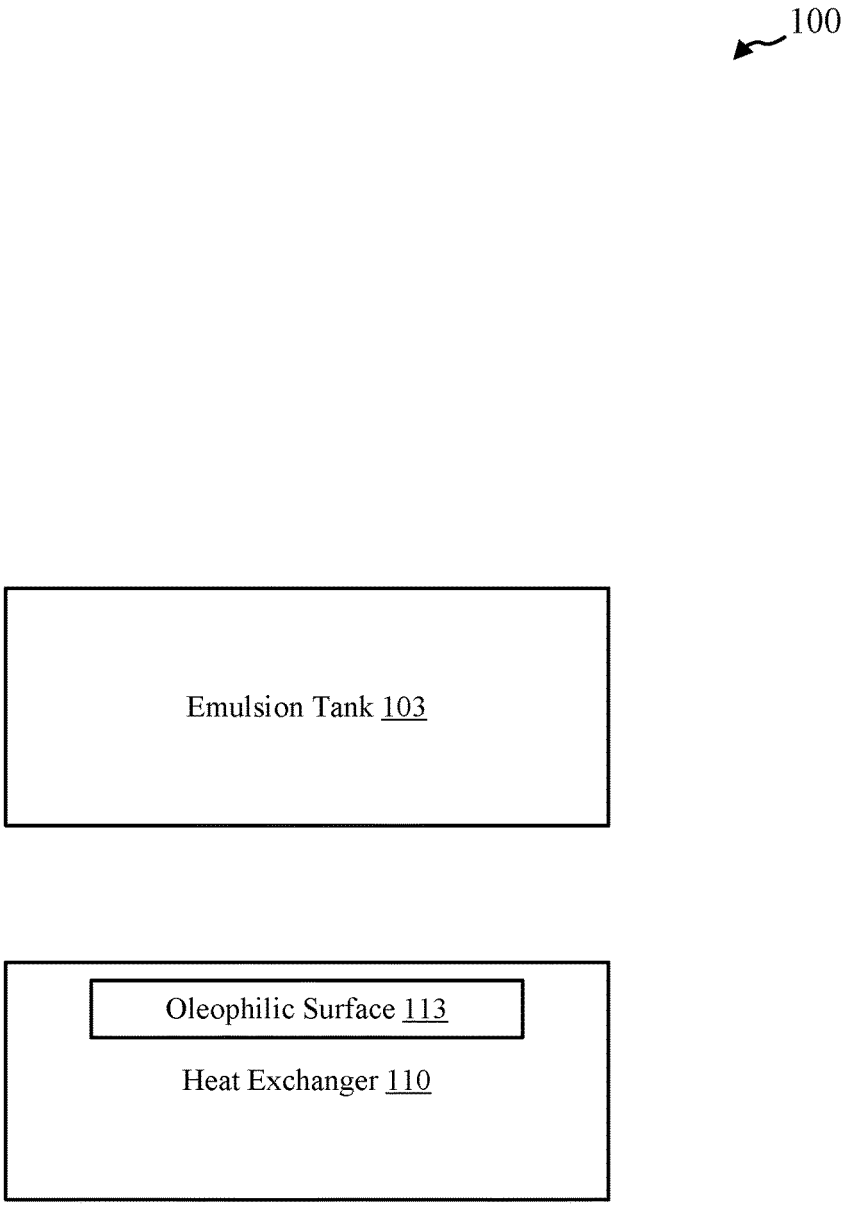
FIG. 1A shows a system and/or device in accordance with various embodiments.

This description provides embodiments, and is not intended to limit the scope, applicability, or configuration of the disclosure. Rather, the ensuing description will provide those skilled in the art with an enabling description for implementing embodiments of the disclosure. Various changes may be made in the function and arrangement of elements.

Thus, various embodiments may omit, substitute, or add various procedures or components as appropriate. For instance, it should be appreciated that the methods may be performed in an order different than that described, and that various stages may be added, omitted or combined. Also, aspects and elements described with respect to certain embodiments may be combined in various other embodiments. It should also be appreciated that the following systems, devices, and methods may individually or collectively be components of a larger system, wherein other procedures may take precedence over or otherwise modify their application.

Solid production systems, devices, and methods utilizing oleophilic surfaces in accordance with various embodiments are provided. For example, some embodiments utilize a self-forming solid-liquid hybrid oleophilic surface. Embodiments generally pertain to the field of refrigeration and heat pumping. Within that field, the embodiments generally apply to the creation of ice or other solids.

Some embodiments include a machine used for the production of ice from water, for example. Some embodiments utilize material combinations and deliberate controlled mixing of those materials to produce ice that can be harvested easily and efficiently.

Some embodiments include a water tank used to store fresh water. Some embodiments include an emulsion tank with a set of auxiliary components that may be utilized to create and pump an emulsion. This auxiliary equipment may include precise level suction headers, ejectors, pumps, mechanical mixers, and or hydrodynamic mixers. Some embodiments include a heat exchanger that may produce a cold surface for ice formation. This surface may include a permanent oleophilic coating that may produce a permanent affinity for oils and/or other non-polar materials. Some embodiments include piping that may allow for the connection of the other components such that ice may be formed from a flow of water and the overflow may be returned to the emulsion tank.

Some embodiments include a method of ice making, or solid making more generally, that may include the following. The emulsion tank may contain a set amount of oil and water. The level of this tank may be maintained by the water tank. As ice is formed from water in the emulsion tank, water may flow from the water tank to maintain the level in the emulsion tank. Emulsion may be formed by the emulsion tank and may be pumped to the cold surface of the heat exchanger. On the cold surface, a balance between two forces may form a thin layer of oil between the water and the oleophilic coating; the shear force of the falling film of emulsion may thin the oil layer, while the surface tension force of the oleophilic coating may grow the oil layer. These forces may balance each other such that a thin layer of oil may be formed. Ice may grow on this oil layer as the water cools and solidifies; this solidification process may break the emulsion and a pure water ice may be formed. Once the ice has grown sufficiently, the flow of water may be stopped; the ice may then be subcooled by the cold surface below its freezing point and the resulting thermal stress may cause the ice to fall off. The emulsion pump may be started again and the process may repeat.

Turning now to FIG. 1A, a system 100 in accordance with various embodiments is provided. System 100 may be referred to as an ice making system, or more generally, a solid making system. System 100 may include an emulsion tank 103 and a heat exchanger 110 with an oleophilic surface 113. System 100 may be utilized for ice making, or more generally, solid making. System 100 may be configured such that an emulsion from the emulsion tank 103 flows down the oleophilic surface 113 to form an oil layer on the oleophilic surface 113 and to form ice on the oil layer.

Some embodiments of system 100 include a pump that delivers the emulsion from the emulsion tank 103 to the oleophilic surface 113 of the heat exchanger 110. Some embodiments include a water tank coupled with the emulsion tank 103 to provide water to the emulsion tank 103. Some embodiments include a suction port positioned with respect to the emulsion tank 103 and the pump to remove water and oil from the emulsion tank 103 to form the emulsion delivered to the oleophilic surface 113 of the heat exchanger 110. The suction port may be at a defined height. Examples of suction port may include, but are not limited to, a wall port or a suction header. Some embodiments include an ejector positioned with respect to the emulsion tank 103 and the pump to mix water and oil from the emulsion tank 103 to form the emulsion delivered to the oleophilic surface 113 of the heat exchanger 110. Some embodiments include a mixer positioned with respect to the emulsion tank 103 and the pump to mix water and oil from the emulsion tank 103 to form the emulsion delivered to the oleophilic surface 113 of the heat exchanger 110.

Some embodiments of the system 100 include the emulsion. In some embodiments, the emulsion includes water and oil. In some embodiments, the oleophilic surface 113 of the heat exchanger 110 is vertically oriented such that the emulsion flows down the oleophilic surface 113 of the heat exchanger 110. In some embodiments, the oleophilic surface 113 of the heat exchanger 110 includes at least PTFE, FEP, Polyethylene, Nylon, Acetal, PVDF, Silicone, or an oleophilic plastic. The oleophilic surface 113 may form a coating of the heat exchanger 110. In some embodiments, the oil includes at least a hydrocarbon oil, a fluorocarbon oil, and a silicone oil.

Figure 1B:
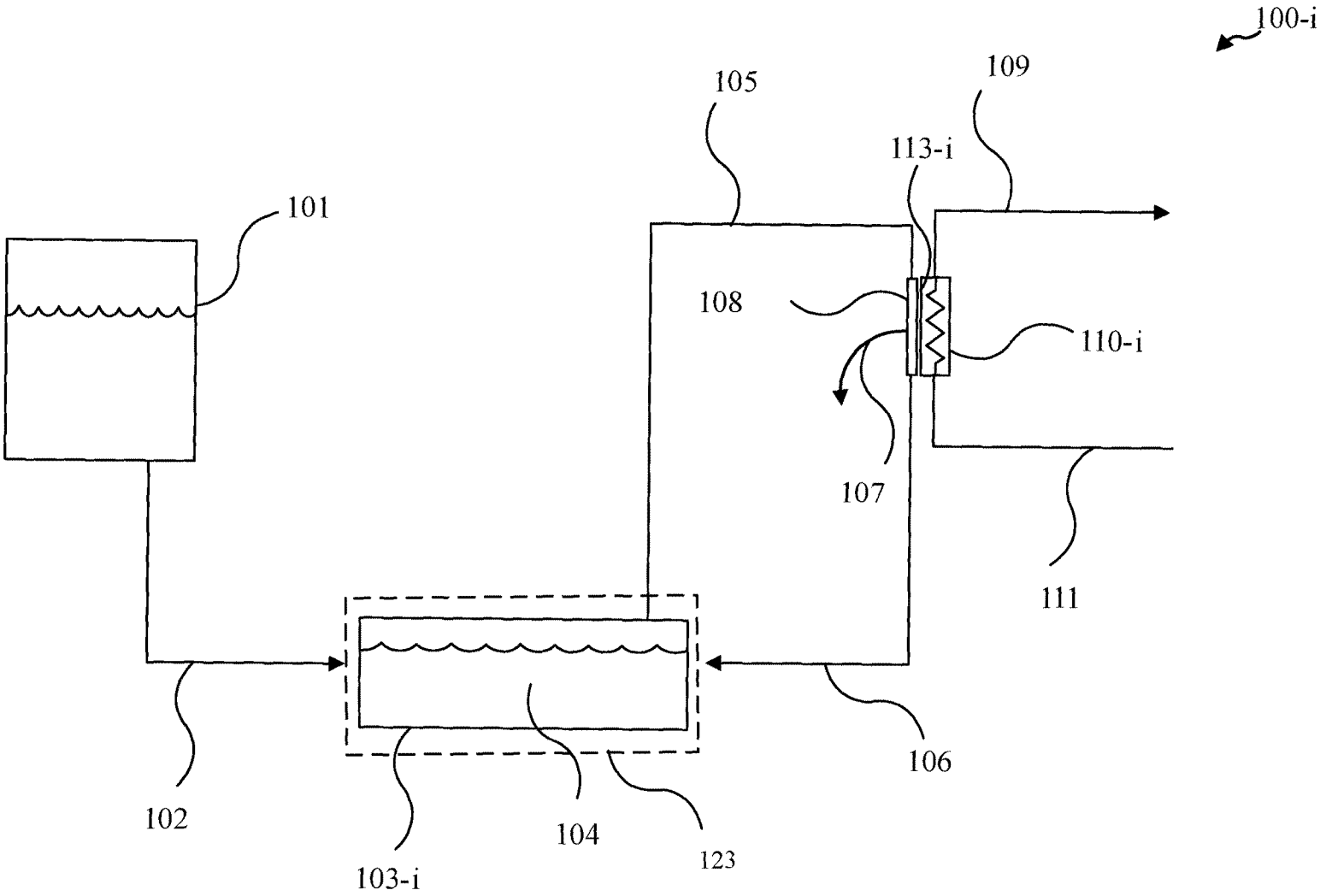
FIG. 1B shows a system and/or device in accordance with various embodiments.

FIG. 1B shows a system 100-*i* in accordance with various embodiments. System 100-*i* may be an example of system 100 of FIG. 1A. A tank 101 may feed an emulsion tank 103-*i* with water 102, which may include fresh water, for example. Emulsion tank 103-*i* may form part of an emulsion tank configuration 123, which may include one or more additional components that may facilitate the formation of emulsion 104. The emulsion tank 103-*i* may contain the emulsion 104 that may flow 105 to an evaporator 110-*i*, as an example of a heat exchanger, with an oleophilic surface 113-*i* where it may form ice 108, which may be pure ice. System 100-*i* may be configured such that emulsion 104 flows down the oleophilic surface 113-*i* to form an oil layer on the oleophilic surface 113-*i* and to form the ice 108 on the oil layer; the oil layer may be represented by the gap shown between the ice 108 and the oleophilic surface 113-*i*. The emulsion flow 106 that may not be separated and may not freeze may return to the emulsion tank 103-*i*. The ice 108 may be formed until it may be of a desired thickness and then may be harvested by falling off 107. The evaporator 110-*i* may be cooled by a supply of refrigerant 111, which may boil absorbing heat and may leave as a gas 109.

In some embodiments, the emulsion tank configuration 123 may include a pump that delivers the emulsion 104 from the emulsion tank 103-*i* to the oleophilic surface 113-*i* of the heat exchanger 110-*i*. Some embodiments of the emulsion tank configuration 123 include a suction port positioned with respect to the emulsion tank 103-*i* and the pump to remove water and oil from the emulsion tank 103-*i* to form the emulsion 105 delivered to the oleophilic surface 113-*i* of the heat exchanger 110-*i*. The suction port may be at a defined height. Examples of suction port may include, but are not limited to, a wall port or a suction header. Some embodiments of the emulsion tank configuration 123 include an ejector positioned with respect to the emulsion tank 103-*i* and the pump to mix water and oil from the emulsion tank 103-*i* to form the emulsion 105 delivered to the oleophilic surface 113-*i* of the heat exchanger 110-*i*. Some embodiments of the emulsion tank configuration 123 include a mixer positioned with respect to the emulsion tank 103-*i* and the pump to mix water and oil from the emulsion tank 103-*i* to form the emulsion 105 delivered to the oleophilic surface 113-*i* of the heat exchanger 110-*i*.

In some embodiments, the emulsion tank 103-*i* may be positioned and/or configured such that the emulsion 105 is gravity fed to the oleophilic surface 113-*i*. In this configuration, a pump (which may be part of emulsion tank configuration 123) could be utilized to direct emulsion flow 106 back to emulsion tank 103-*i*.

As may be shown in system 100-*i*, the oleophilic surface 113-*i* of the heat exchanger 110-*i* may be vertically oriented such that the emulsion 105 flows down the oleophilic surface 113-*i* of the heat exchanger 110-*i*. In some embodiments, the oleophilic surface 113-*i* of the heat exchanger 110-I includes at least PTFE, FEP, Polyethylene, Nylon, Acetal, PVDF, Silicone, or another oleophilic plastic. The oleophilic surface 113-*i* may form a coating of the heat exchanger 110-*i*. In some embodiments, the oil of emulsion 105 includes at least a hydrocarbon oil, a fluorocarbon oil, and a silicone oil.

Figure 2A:
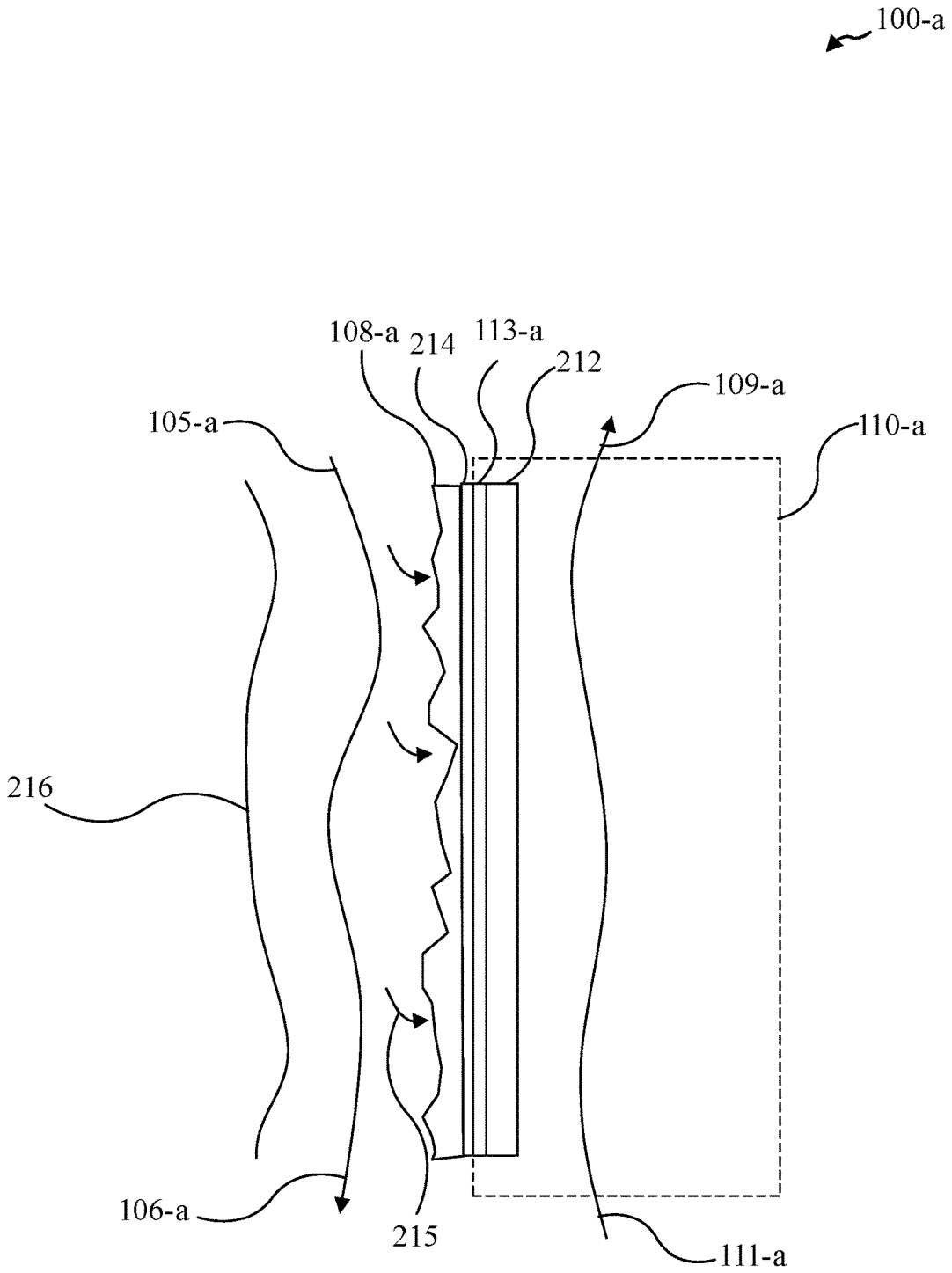
FIG. 2A show a system and/or device in accordance with various embodiments.

FIG. 2A shows a system 100-*a* that may be an example of aspects of system 100 of FIG. 1A and/or system 100-*i* of FIG. 1B. In particular, system 100-*a* may include an evaporator's cold surface during ice growth. An evaporator 110-*a* may have a refrigerant liquid 111-*a* flowing into it and leaving as a gas 109-*a*. A metal surface 212 of the evaporator 110-*a* may be coated in an oleophilic coating to form an oleophilic surface 113-*a*. When operating, this surface 212 and/or 113-*a* may create a surface energy condition that may cause a thin film of oil 214 to form on the surface 212 and/or 113-*a*. The surface tension/energy condition may cause this film to grow while the shear created by the falling film of emulsion 216 flowing into 105-*a* and falling off 106-*a* the surface 212 and/or 113-*a* may cause the film to shrink. The balance of these force may control the thickness. As ice 108-*a* grows on the oil coated surface 212 and/or 113-*a*, it may pull water 215, which may be pure, out of the emulsion 216 as the oil may be precluded from the crystal structure of the ice 108-*a*.

Figure 2B:
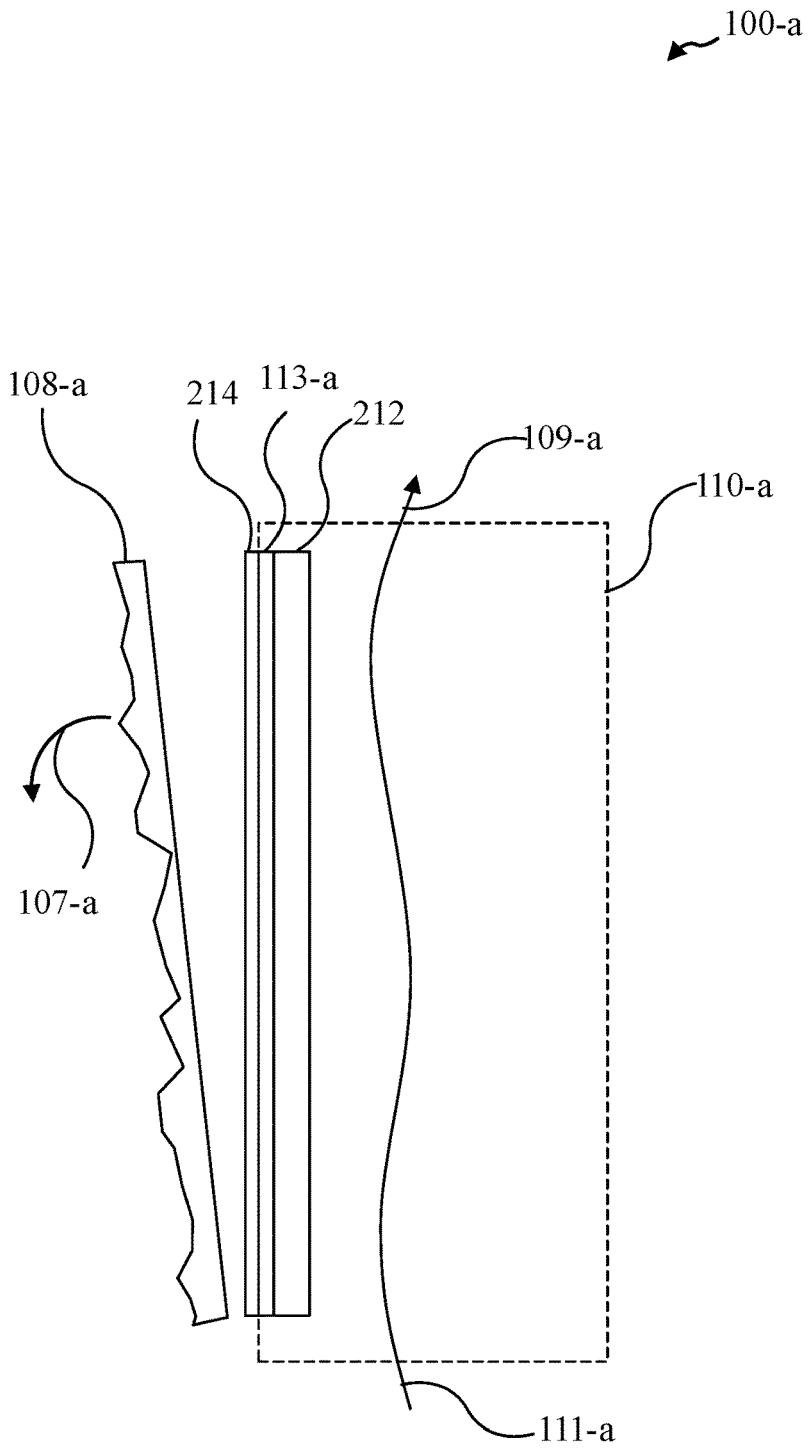
FIG. 2B shows a system and/or device in accordance with various embodiments.

FIG. 2B provides details of system 100-*a* that may reflect the evaporator's cold surface during ice harvest in accordance with various embodiments. The evaporator 110-*a* may have the refrigerant liquid 111-*a* flowing into it and leaving as the gas 109-*a*. The metal surface 212 of the evaporator 110-*a* may be include the oleophilic surface 113-*a*. To harvest the ice 108-*a*, the flow of emulsion may be curtailed while the flow of refrigerant continues. As the ice 108-*a*, which may start at 0° C. for example, may be cooled further (i.e., subcooled) to temperatures below 0° C., −10° C. for example, by the refrigerant, it may create thermal stress at the ice-oil interface that may cause the sheet of ice 108-*a* to fall away 107-*a* from the evaporator surface 212 and/or oleophilic surface 113-*a*. In some embodiments, surface 212 and oleophilic surface 113-*a* of evaporator 110-*a* are integrated to form an integrated surface that may not be distinguishable as two separate surfaces.

Figure 3A:
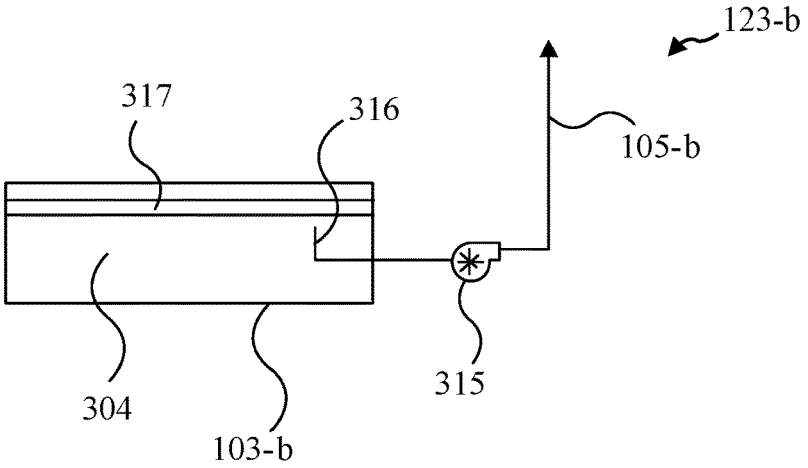
FIG. 3A shows aspects of a system and/or device in accordance with various embodiments.

Turning now to FIG. 3A, an emulsion tank configuration 123-*b* with an emulsion tank 103-*b* is provided in accordance with various embodiments. The tank 103-*b* may include two liquids: a light emulsion and/or water 304 and a layer of free lighter-than-water oil 317. A pump 315 may remove liquid from the tank 103-*b* via a suction port, such as suction header 316, with a precise height of liquid separating it from the free oil 317; some embodiments utilize a wall port or other suction port. This height may be chosen by selecting a port diameter, overall flow rate, height of separation from free oil, and/or flow geometry such that the port inlet velocity and port inlet's flow profile may bring in a mixture of free oil 317 and light emulsion and/or water 304 to create a heavy emulsion 105-*b*, which may be sent to an evaporator or other heat exchanger (such as heat exchangers 110 of FIG. 1A, FIG. 1B, FIG. 2A, and/or FIG. 2B).

Figure 3B:
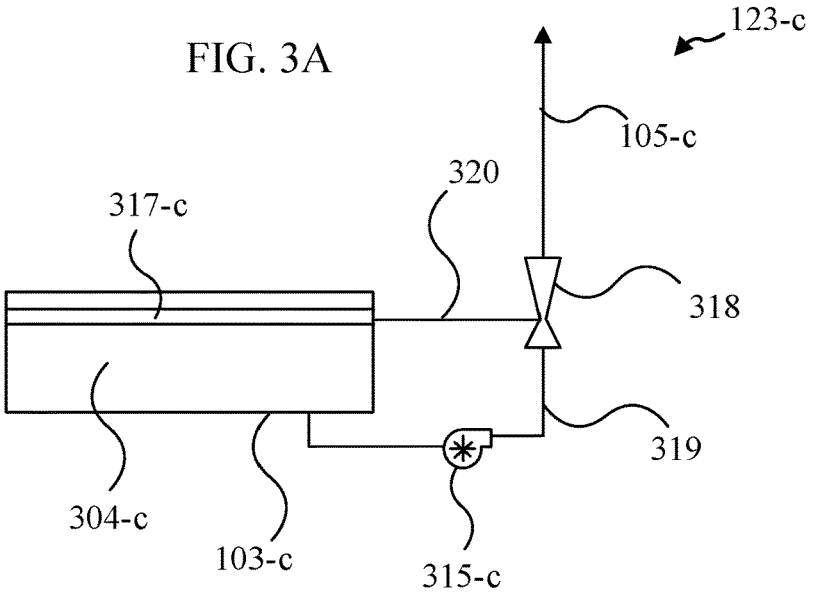
FIG. 3B shows aspects of a system and/or device in accordance with various embodiments.

FIG. 3B provides another emulsion tank configuration 123-*c* with an emulsion tank 103-*c* in accordance with various embodiments. The tank 103-*c* may include two liquids: a light emulsion and/or water 304-*c* and a layer of free lighter-than-water oil 317-*c*. A pump 315-*c* may remove liquid from the tank 103-*c* and may send it via a line 319 to an ejector 318, which may create suction on a line 320 that may be connected to the tank 103-*c* at a height that may allow it to suck in a significant amount of free oil. Inside the ejector 318, the two lines may mix and a heavy emulsion 105-*c* may be formed, which may be sent to an evaporator or other heat exchanger (such as heat exchangers 110 of FIG. 1A, FIG. 1B, FIG. 2A, and/or FIG. 2B).

Figure 3C:
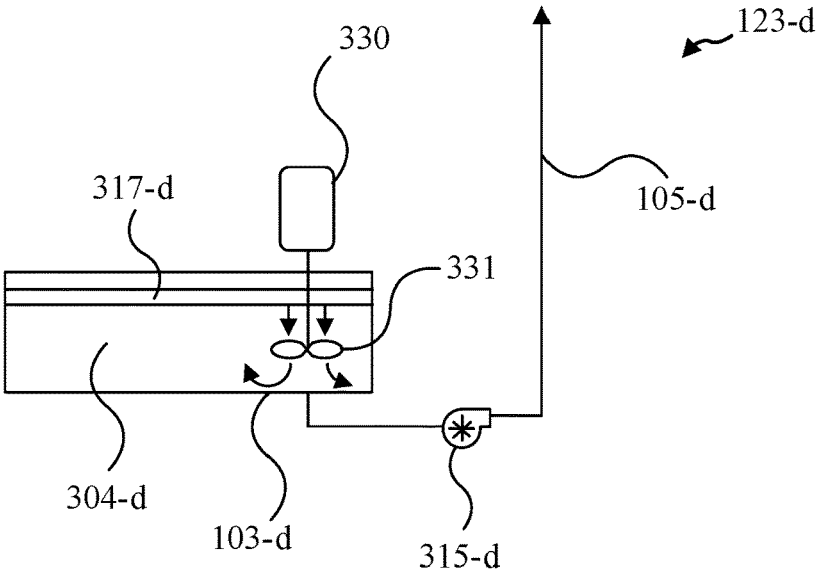
FIG. 3C shows aspects of a system and/or device in accordance with various embodiments.

FIG. 3C provides another emulsion tank configuration 123-*d* with an emulsion tank 103-*d* in accordance with various embodiments. The tank 103-*d* may include two liquids: a light emulsion and/or water 304-*d* and a layer of free lighter-than-water oil 317-*d*. A mechanical mixer 330 with a paddle 331 that may pull liquid down from the free oil layer 317-*d* may be position over the suction line of a pump 315-*d*, which removes liquid from the tank 103-*d*. The pump 315-*d* may suck both free oil 317-*d* and light emulsion and/or water 304-*d* and may form a heavy emulsion 105-*d*, which may be sent an evaporator or other heat exchanger (such as heat exchangers 110 of FIG. 1A, FIG. 1B, FIG. 2A, and/or FIG. 2B).

In general, configurations 123-*b*, 123-*c*, and/or 123-*d* may include a lighter-than-water oil, such as hydrocarbon oil or silicone oil. Configurations 123-*b*, 123-*c*, and/or 123-*d* may be shown in an initial state with respect to the layers 304 and 317 shown, but may form a more mixed emulsion over time, such as emulsion 104 shown with respect to FIG. 1B, for example. Configurations 123-*b*, 123-*c*, and/or 123-*d* may be examples of aspects of system 100 of FIG. 1A and/or system 100-*i* of FIG. 1B and may be integrated with systems such as system 100-*a* of FIG. 2A and/or FIG. 2B.

Figure 4A:
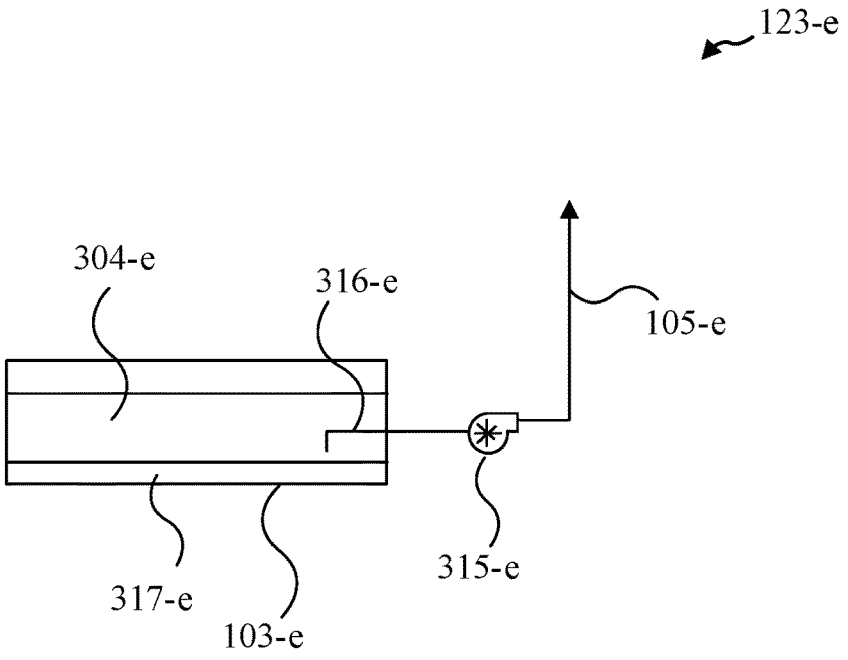
FIG. 4A shows aspects of a system and/or device in accordance with various embodiments.

Turning now to FIG. 4A, an emulsion tank configuration 123-*e* with an emulsion tank 103-*e* is provided in accordance with various embodiments. The tank 103-*e* may include two liquids: a light emulsion and/or water 304-*e* and a layer of free heavier-than-water oil 317-*e*. A pump 315-*e* may remove liquid from the tank 103-*e* via a suction header 316-*e* with a precise height of liquid separating it from the free oil 317-*e*; some embodiments utilize a wall port or other suction port. This height may be chosen by selecting a port diameter, overall flow rate, height of separation from free oil, and/or flow geometry such that the port inlet velocity and port inlet's flow profile may bring in a mixture of free oil 317-*e* and light emulsion and/or water 304-*e* to create a heavy emulsion 105-*e*, which can be sent to an evaporator or other heat exchanger (such as heat exchangers 110 of FIG. 1A, FIG. 1B, FIG. 2A, and/or FIG. 2B).

Figure 4B:
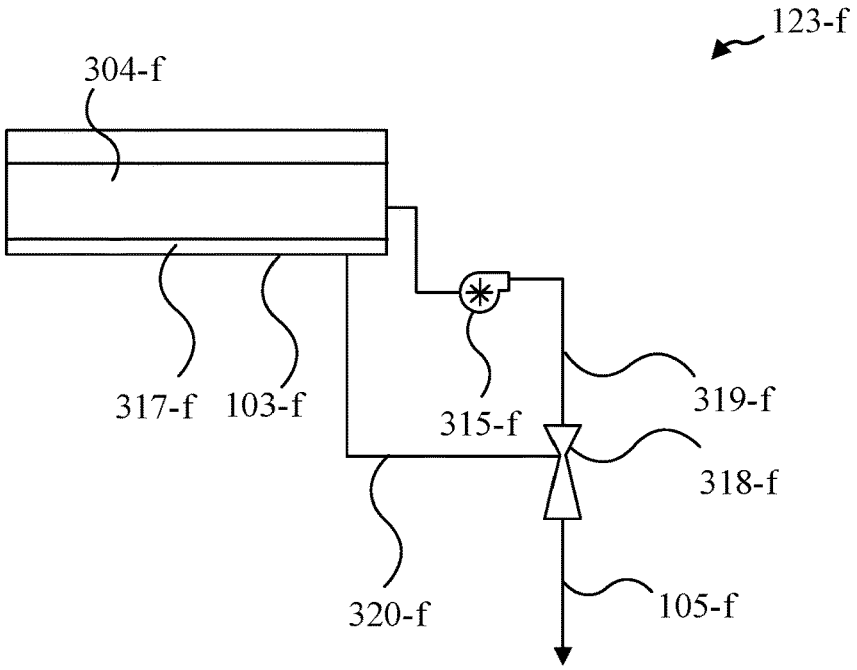
FIG. 4B shows aspects of a system and/or device in accordance with various embodiments.

FIG. 4B provides another emulsion tank configuration 123-*f* with an emulsion tank 103-*f* in accordance with various embodiments. The tank 103-*e* may include two liquids: a light emulsion and/or water 304-*f* and a layer of free heavier-than-water oil 317-*f*. A pump 315-*f* may remove liquid from the tank 103-*f* and may send it via line 319-*f* to an ejector 318-*f*, which may create suction on a line 320-*f* that may be connected to the tank 103-*f* at a height that may allow it to suck in a significant amount of free oil 317-*f*. Inside the ejector 318-*f*, the two lines may mix and a heavy emulsion 105-*f* may be formed, which can be sent to an evaporator or other heat exchanger (such as heat exchangers 110 of FIG. 1A, FIG. 1B, FIG. 2A, and/or FIG. 2B).

Figure 4C:
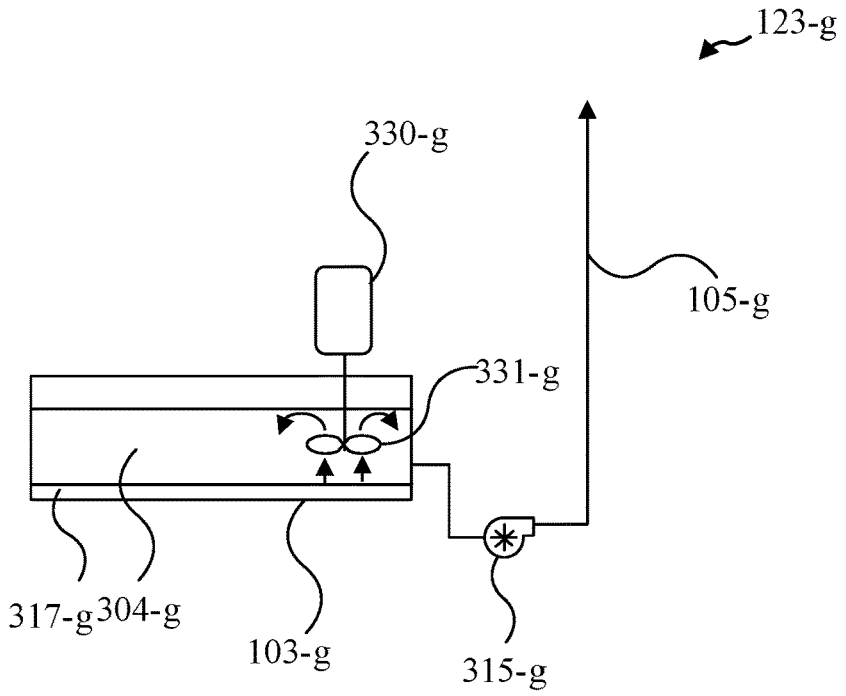
FIG. 4C shows aspects of a system and/or device in accordance with various embodiments.

FIG. 4C provides another emulsion tank configuration 123-*g* with an emulsion tank 103-*g* in accordance with various embodiments. The tank 103-*g* may include two liquids: a light emulsion and/or water 304-*g* and a layer of free heavier-than-water oil 317-*g*. A mechanical mixer 330-*g* with a paddle 331-*g*, which may pull liquid up from the free oil layer 317-*g*, may be positioned next to the suction line of a pump 315-*g*, which may remove liquid from the tank 103-*g*. The pump 315-*g* may suck both free oil 317-*g* and light emulsion and/or water 304-*g* and may form a heavy emulsion 105-*g*, which can be sent to an evaporator or other heat exchanger (such as heat exchangers 110 of FIG. 1A, FIG. 1B, FIG. 2A, and/or FIG. 2B).

Figure 4D:
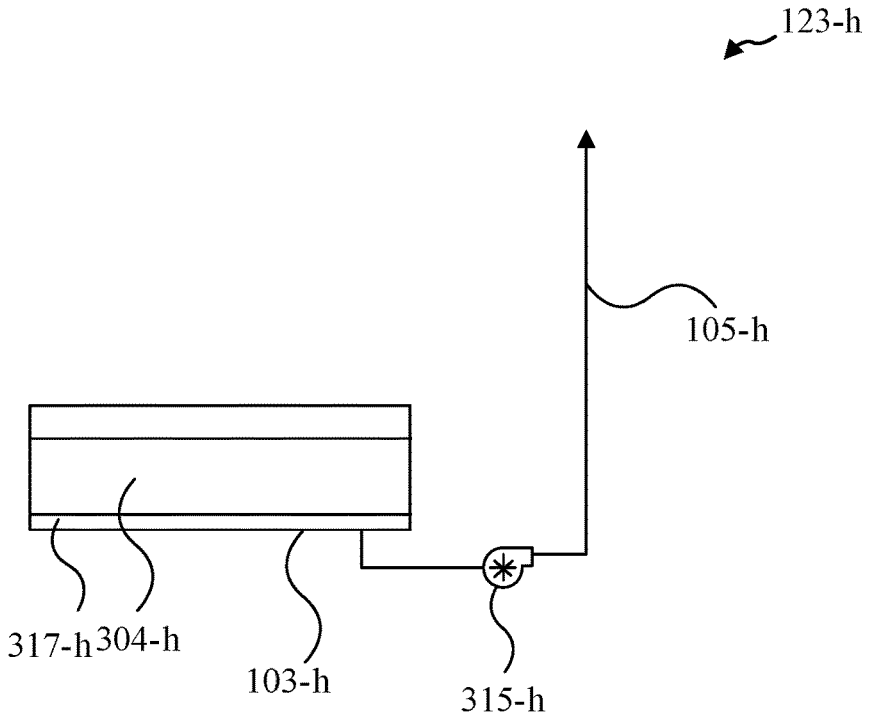
FIG. 4D shows aspects of a system and/or device in accordance with various embodiments.

FIG. 4D provides another emulsion tank configuration 123-*h* with an emulsion tank 103-*h* in accordance with various embodiments. The tank 103-*h* may include two liquids: a light emulsion and/or water 304-*h* and a layer of free heavier-than-water oil 317-*h*. A pump 315-*h* may remove liquid from the bottom of the tank 103-*h*. The oil layer 317-*h* may be of a thickness such that the pump 315-*h* pulls in both free oil 317-*h* and light emulsion and/or water 304-*h* and may form a heavy emulsion 105-*h*, which can be sent to an evaporator or other heat exchanger (such as heat exchangers 110 of FIG. 1A, FIG. 1B, FIG. 2A, and/or FIG. 2B).

In general, configurations 123-*e*, 123-*f*, 123-*g*, and/or 123-*h* may include a heavier-than-water oil, such as fluorocarbon oil. Configurations 123-*e*, 123-*f*, 123-*g*, and/or 123-*h* may be shown in an initial state with respect to the layers 304 and 317 shown, but may form a more mixed emulsion over time, such as emulsion 104 shown with respect to FIG. 1B, for example. Configurations 123-*e*, 123-*f*, 123-*g*, and/or 123-*h* may be examples of aspects of system 100 of FIG. 1A and/or system 100-*i* of FIG. 1B and may be integrated with systems such as system 100-*a* of FIG. 2A and/or FIG. 2B.

Figure 5:
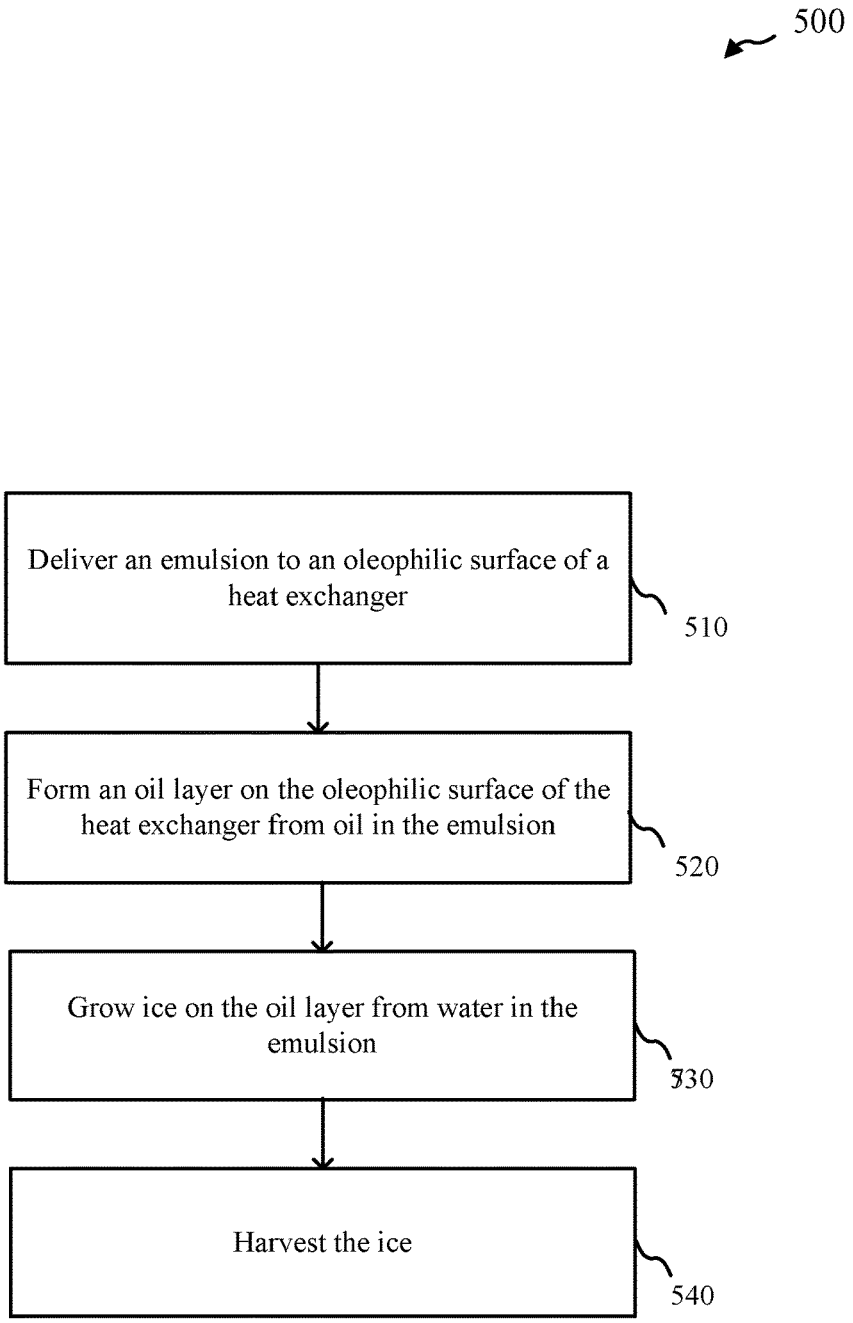
FIG. 5 shows a flow diagram of a method in accordance with various embodiments.

Turning now to FIG. 5 a flow diagram of a method 500 of ice making (or solid making more generally) is shown in accordance with various embodiments. Method 500 may be implemented utilizing a variety of systems and/or devices such as those shown and/or described with respect to FIG. 1A, FIG. 1B, FIG. 2A, FIG. 2B, FIG. 3A, FIG. 3B, FIG. 3C, FIG. 4A, FIG. 4B, FIG. 4C, and/or FIG. 4D.

At block 510, an emulsion may be delivered to an oleophilic surface of a heat exchanger. At block 520, an oil layer may be formed on the oleophilic surface of the heat exchanger from oil in the emulsion. At block 530, ice may be grown on the oil layer from water in the emulsion. At block 540, the ice may be harvested.

Some embodiments of method 500 include curtailing the delivering of the emulsion to the oleophilic surface of the heat exchanger. The ice on the oil layer may be subcooled (i.e., further cooled) after curtailing the delivering of the emulsion to the oleophilic surface of the heat exchanger; this may facilitate the harvesting of the ice.

In some embodiments of method 500, delivering the emulsion to the oleophilic surface of the heat exchanger includes flowing the emulsion down the oleophilic surface of the heat exchanger. In general, delivering the emulsion to the oleophilic surface of the heat exchanger can include flowing the emulsion across the oleophilic surface of the heat exchanger. This flowing may include spraying and/or cascading the emulsion across the oleophilic surface of the heat exchanger. In some embodiments, harvesting the ice utilizes gravity such that the ice falls away from the oleophilic surface of the heat exchanger.

Some embodiments of method 500 include pumping the emulsion from an emulsion tank to deliver the emulsion to the oleophilic surface of the heat exchanger. Some embodiments include returning a portion of the emulsion to the emulsion tank after delivering the emulsion to the oleophilic surface of the heat exchanger. Some embodiments include delivering additional water to the emulsion tank.

Some embodiments of method 500 include forming the emulsion through combining oil and water. In some embodiments, forming the emulsion through combining the oil and the water includes utilizing suction in an emulsion tank to bring the oil and the water together to form the emulsion. In some embodiments, forming the emulsion through combining the oil and the water includes pumping the water to an ejector that forms suction with respect to the oil to bring the oil and the water together to form the emulsion. In some embodiments, forming the emulsion through combining the oil and the water includes utilizing a mechanical mixer to combine the oil and the water.

In some embodiments of method 500, the oleophilic surface of the heat exchanger is vertically oriented such that the emulsion flows down the oleophilic surface of the heat exchanger. In some embodiments, the oleophilic surface of the heat exchanger includes at least PTFE, FEP, Polyethylene, Nylon, Acetal, PVDF, Silicone, or an oleophilic plastic. In some embodiments, the oil includes at least a hydrocarbon oil, a fluorocarbon oil, and a silicone oil.

A wide variety of different components and/or materials may be utilized with respect to the systems, devices, and methods described herein. Merely by way of example, an emulsion generally includes a non-solution mixture of two immiscible liquids. For example, an emulsion may include a mixture of immiscible fluids that may not be separated into two distinct contiguous phases. Instead, the two phases may be distributed throughout each other in some way. This may be in droplets that are on the order of nm up to cm or larger, for example. In general, the two liquids may be inter-mixed and may not be sitting in two contiguous phases. Examples of emulsions include, but are not limited to, water and hydrocarbon oil, water and silicone oil, water and fluorocarbon oil, and/or ethanol and silicone oil. Examples of free oil may include oil that may form a contiguous liquid body free of immiscible liquids like water. A light emulsion may include in general an emulsion that contains a small amount of oil, while a heavy emulsion may include in general an emulsion that contains a large amount of oil; for example, a light emulsion may have less oil in it than a heavy emulsion. Oleophilic surfaces generally include a surface and/or coating that attracts oils due to surface energy characteristics. Metal surfaces of heat exchangers generally include a surface composed of a metal, such as stainless steel, carbon steel, aluminum, copper, which may form a barrier of the heat exchanger. While embodiments provided refer to general heat exchangers, such as evaporators, other types of heat exchangers could be utilized, including, but not limited to, liquid cooled heat exchangers, brine cooled heat exchangers, glycol cooled heat exchangers, gas cooled heat exchangers, and/or air cooled heat exchangers.

These embodiments may not capture the full extent of combination and permutations of materials and process equipment. However, they may demonstrate the range of applicability of the method, devices, and/or systems. The different embodiments may utilize more or less stages than those described.

It should be noted that the methods, systems, and devices discussed above are intended merely to be examples. It must be stressed that various embodiments may omit, substitute, or add various procedures or components as appropriate. For instance, it should be appreciated that, in alternative embodiments, the methods may be performed in an order different from that described, and that various stages may be added, omitted or combined. Also, features described with respect to certain embodiments may be combined in various other embodiments. Different aspects and elements of the embodiments may be combined in a similar manner. Also, it should be emphasized that technology evolves and, thus, many of the elements are exemplary in nature and should not be interpreted to limit the scope of the embodiments.

Specific details are given in the description to provide a thorough understanding of the embodiments. However, it will be understood by one of ordinary skill in the art that the embodiments may be practiced without these specific details. For example, well-known circuits, processes, algorithms, structures, and techniques have been shown without unnecessary detail in order to avoid obscuring the embodiments.

Also, it is noted that the embodiments may be described as a process which may be depicted as a flow diagram or block diagram or as stages. Although each may describe the operations as a sequential process, many of the operations can be performed in parallel or concurrently. In addition, the order of the operations may be rearranged. A process may have additional stages not included in the figure.

Having described several embodiments, it will be recognized by those of skill in the art that various modifications, alternative constructions, and equivalents may be used without departing from the spirit of the different embodiments. For example, the above elements may merely be a component of a larger system, wherein other rules may take precedence over or otherwise modify the application of the different embodiments. Also, a number of stages may be undertaken before, during, or after the above elements are considered. Accordingly, the above description should not be taken as limiting the scope of the different embodiments.

What is claimed is:

1. A method of ice making comprising:

delivering an emulsion to an oleophilic surface of a heat exchanger;

forming an oil layer on the oleophilic surface of the heat exchanger from oil in the emulsion;

growing an ice sheet on the oil layer on the oleophilic surface of the heat exchanger from water in the emulsion;

curtailing the delivering of the emulsion to the oleophilic surface of the heat exchanger;

subcooling the ice sheet grown on the oil layer on the oleophilic surface of the heat exchanger after curtailing the delivering of the emulsion to the oleophilic surface of the heat exchanger; and harvesting the ice sheet through the ice sheet, which is subcooled, falling away from the oleophilic surface of the heat exchanger.

2. The method of ice making of claim 1, wherein delivering the emulsion to the oleophilic surface of the heat exchanger includes flowing the emulsion down the oleophilic surface of the heat exchanger.

3. The method of ice making of claim 1, wherein harvesting the ice utilizes gravity such that the ice falls away from the oleophilic surface of the heat exchanger.

4. The method of ice making of claim 1, further comprising pumping the emulsion from an emulsion tank to deliver the emulsion to the oleophilic surface of the heat exchanger.

5. The method of ice making of claim 4, further comprising returning a portion of the emulsion to the emulsion tank after delivering the emulsion to the oleophilic surface of the heat exchanger.

6. The method of ice making of claim 5, further comprising delivering additional water to the emulsion tank.

7. The method of ice making of claim 1, further comprising forming the emulsion through combining oil and water.

8. The method of ice making of claim 7, wherein forming the emulsion through combining the oil and the water includes utilizing suction in an emulsion tank to bring the oil and the water together to form the emulsion.

9. The method of ice making of claim 7, wherein forming the emulsion through combining the oil and the water includes pumping the water to an ejector that forms suction with respect to the oil to bring the oil and the water together to form the emulsion.

10. The method of ice making of claim 7, wherein forming the emulsion through combining the oil and the water includes utilizing a mechanical mixer to combine the oil and the water.

11. The method of ice making of claim 1, wherein the oleophilic surface of the heat exchanger is vertically oriented such that the emulsion flows down the oleophilic surface of the heat exchanger.

12. The method of ice making of claim 1, wherein the oleophilic surface of the heat exchanger includes at least PTFE, FEP, Polyethylene, Nylon, Acetal, PVDF, Silicone, or an oleophilic plastic.

13. The method of ice making of claim 1, wherein the oil includes at least a hydrocarbon oil, a fluorocarbon oil, and a silicone oil.

* * * * *